US010526675B2

(12) United States Patent
Kochi et al.

(10) Patent No.: US 10,526,675 B2
(45) Date of Patent: Jan. 7, 2020

(54) METHOD FOR MANUFACTURING STEEL FOR HIGH-STRENGTH HOLLOW SPRING

(71) Applicants: Kobe Steel, Ltd., Kobe-shi (JP); NHK SPRING CO., LTD., Yokohama-shi (JP)

(72) Inventors: Takuya Kochi, Kobe (JP); Hitoshi Hatano, Kobe (JP); Akira Tange, Yokohama (JP); Kiyoshi Kurimoto, Yokohama (JP); Yurika Goto, Yokohama (JP)

(73) Assignees: Kobe Steel, Ltd., Kobe-shi (JP); NHK SPRING CO., LTD., Yokohama-shi (JP)

( * ) Notice: Subject to any disclaimer, the term of this patent is extended or adjusted under 35 U.S.C. 154(b) by 224 days.

(21) Appl. No.: 15/520,616

(22) PCT Filed: Oct. 26, 2015

(86) PCT No.: PCT/JP2015/080126
§ 371 (c)(1),
(2) Date: Apr. 20, 2017

(87) PCT Pub. No.: WO2016/068082
PCT Pub. Date: May 6, 2016

(65) Prior Publication Data

US 2017/0306432 A1 Oct. 26, 2017

(30) Foreign Application Priority Data

Oct. 31, 2014 (JP) ..... 2014-222840

(51) Int. Cl.
*C21D 9/08* (2006.01)
*C22C 38/06* (2006.01)
(Continued)

(52) U.S. Cl.
CPC ..... *C21D 9/08* (2013.01); *C21D 6/005* (2013.01); *C21D 6/008* (2013.01); *C21D 9/02* (2013.01);
(Continued)

(58) Field of Classification Search
CPC ..... C21D 6/005; C21D 6/008; C21D 9/02; C21D 9/08; C22C 38/00; C22C 38/001;
(Continued)

(56) References Cited

U.S. PATENT DOCUMENTS

2012/0070682 A1 3/2012 Hatano et al.
2012/0325364 A1 12/2012 Kochi et al.
2015/0159245 A1 6/2015 Kochi et al.

FOREIGN PATENT DOCUMENTS

CN 103725984 A 4/2014
JP 60-24166 B2 6/1985
(Continued)

OTHER PUBLICATIONS

International Search Report dated Jan. 26, 2016, in PCT/JP2015/080126 filed Oct. 26, 2015.
(Continued)

*Primary Examiner* — Jenny R Wu
(74) *Attorney, Agent, or Firm* — Oblon, McClelland, Maier & Neustadt, L.L.P.

(57) ABSTRACT

A method for manufacturing steel, by quenching and tempering a seamless pipe for use as a material of a hollow spring, where the seamless pipe including predetermined components is subjected to a heat treatment which is performed to satisfy quenching conditions (1) and tempering conditions (2), (1) quenching conditions:

$$26{,}000 \le (T1+273)\times(\log(t1)+20) \le 29{,}000$$

$$900°\ C. \le T1 \le 1{,}050°\ C.,$$

$$10\ \text{seconds} \le t1 \le 1{,}800\ \text{seconds}, \qquad \text{formula (1)}$$

(Continued)

where T1 is a quenching temperature (° C.), and t1 is a holding time (seconds) in a temperature range of 900° C. or higher, and (2) tempering conditions:

$$13{,}000 \leq (T2+273) \times (\log(t2)+20) \leq 15{,}500$$

$$T2 \leq 550°\ \text{C., and}$$

$$t2 \leq 3{,}600\ \text{seconds,} \qquad \text{formula (2)}$$

where T2 is a tempering temperature (° C.), and t2 is a total time (seconds) from start of heating to completion of cooling.

4 Claims, 1 Drawing Sheet

(51) Int. Cl.

| | |
|---|---|
| ***C22C 38/02*** | (2006.01) |
| ***C21D 6/00*** | (2006.01) |
| ***C22C 38/00*** | (2006.01) |
| ***C22C 38/18*** | (2006.01) |
| ***C22C 38/04*** | (2006.01) |
| ***C21D 9/02*** | (2006.01) |
| ***C22C 38/50*** | (2006.01) |
| ***C22C 38/20*** | (2006.01) |
| ***C22C 38/46*** | (2006.01) |
| ***C22C 38/42*** | (2006.01) |
| ***C22C 38/48*** | (2006.01) |
| ***C22C 38/40*** | (2006.01) |

(52) U.S. Cl.
CPC ..... *C22C 38/00* (2013.01); *C22C 38/001* (2013.01); *C22C 38/02* (2013.01); *C22C 38/04* (2013.01); *C22C 38/06* (2013.01); *C22C 38/18* (2013.01); *C22C 38/20* (2013.01); *C22C 38/40* (2013.01); *C22C 38/42* (2013.01); *C22C 38/46* (2013.01); *C22C 38/48* (2013.01); *C22C 38/50* (2013.01)

(58) Field of Classification Search
CPC ..... C22C 38/02; C22C 38/04; C22C 38/06; C22C 38/18; C22C 38/20; C22C 38/40; C22C 38/42; C22C 38/46; C22C 38/48; C22C 38/50
See application file for complete search history.

(56) References Cited

FOREIGN PATENT DOCUMENTS

| | | | | |
|---|---|---|---|---|
| JP | 62-120430 | A | | 6/1987 |
| JP | 62120430 | A | * | 6/1987 |
| JP | 9-324219 | A | | 12/1997 |
| JP | 2007-125588 | A | | 5/2007 |
| JP | 2009-79280 | A | | 4/2009 |
| JP | 2010-265523 | A | | 11/2010 |
| JP | 2011-184704 | A | | 9/2011 |
| JP | 2012-111979 | A | | 6/2012 |
| JP | 2012111979 | A | * | 6/2012 |
| JP | 2013-256681 | A | | 12/2013 |

OTHER PUBLICATIONS

International Preliminary Report on Patentability dated May 11, 2017 in corresponding PCT/JP2015/080126 (with English translation).

* cited by examiner

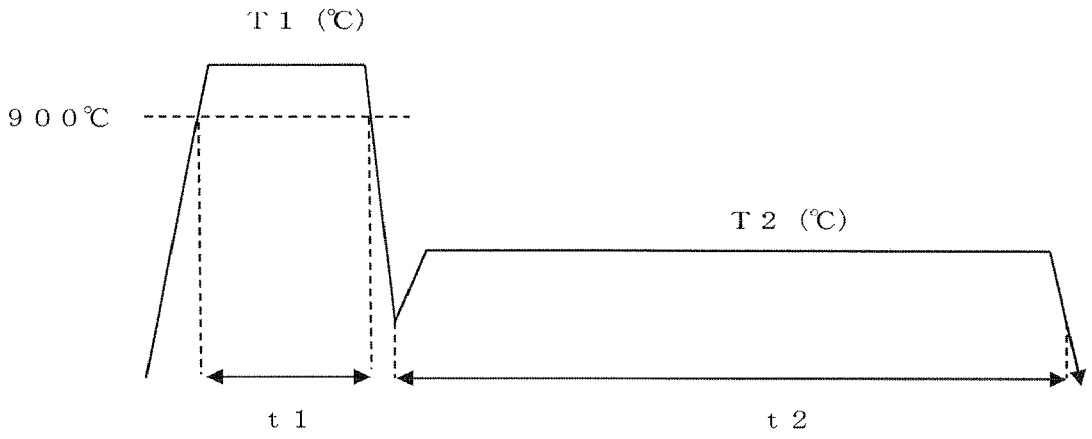
T 1 (℃)
9 0 0℃
T 2 (℃)
t 1
t 2

METHOD FOR MANUFACTURING STEEL FOR HIGH-STRENGTH HOLLOW SPRING

TECHNICAL FIELD

The present invention relates to a method for manufacturing steel for a high-strength hollow spring. The term "steel for a hollow spring" as used in the present specification means steel obtained by quenching and tempering a seamless pipe for use as a material for a hollow spring.

BACKGROUND ART

With increasing demands for reducing the weight or enhancing the output of automobiles or the like, springs, such as valve springs, clutch springs, and suspension springs, which are used in the engine, clutch, suspension, etc., tend to be higher strength and thinner diameters. Together with this, the properties required for springs, including the resistance to hydrogen embrittlement, the fatigue resistance, and the setting resistance, are becoming increasingly higher. It is strongly desired to provide a spring steel that can manufacture a spring excellent in these properties.

To produce lightweight springs that are excellent in the spring properties, such as the resistance to hydrogen embrittlement and the fatigue resistance, pipe-shaped hollow steels with no weld bead, i.e., seamless pipes are used as material for a spring steel, in place of solid steels, such as a steel bar, which have been used before. The seamless pipe is also called a seamless steel tube.

However, when using the seamless pipe as the material for hollow springs, various problems occur, especially, in terms of manufacturing seamless pipes. That is, to ensure the fatigue strength of the solid steel for use as the material for springs, which are not hollow, generally, a surface layer part of the steel is hardened by shot-peening or the like, thereby applying residual stress to its outer surface. In contrast, the seamless pipe can have its outer peripheral surface subjected to shot-peening in the same way, but its inner peripheral surface cannot undergo the shot-peening. When decarburization occurs at a pipe surface layer located on the inner peripheral surface side of the pipe, adequate hardening on the inner peripheral surface side cannot be obtained during quenching in a spring production procedure, failing to ensure fatigue strength required by springs. Furthermore, the presence of a defect at the surface layer of the inner peripheral surface becomes a stress concentration part, which might cause the breakage of the pipe at an early stage.

During steel production, a small amount of hydrogen, which would cause cracking, is inevitably introduced into and present in the steel. Such a small amount of hydrogen is not problematic for the solid spring, but significantly affects the durability of a hollow spring. In particular, the hollow spring cannot have its inner surface subjected to shot-peening as mentioned above, and thus the hollow spring is required to have an even higher quality of resistance to hydrogen embrittlement than the solid spring.

For these problems, some technical studies have taken place in terms of production of a seamless pipe as a material. In a technique mentioned in Patent Document 1, hot isostatic pressing extrusion is performed on a workpiece of steel to form a hollow seamless pipe shape, followed by spheroidizing annealing, and subsequently extending (drawing) the shape by cold pilger mill rolling, cold drawing, or the like. As a result, according to a seamless steel tube of Patent Document 1, the depth of continuous defects formed at the inner and outer peripheral surfaces of the steel tube can be reduced to 50 μm or less from each surface.

In a technique mentioned in Patent Document 2, a steel bar is hot-rolled, followed by perforation with a gun drill, and then is subjected to cold working (drawn, or rolled). As a result, a hollow seamless pipe for a high-strength spring of Patent Document 2 is produced that can control a C content at the inner and outer peripheral surfaces to 0.10% or more, while reducing the thickness of an entire decarburized layer to 200 μm or less at each of the inner and outer peripheral surfaces.

Patent Document 3 has studied the relationship between the metal microstructure and durability of seamless pipes and thereby disclosing a seamless steel tube for a high-strength hollow spring in which a carbide has a circle-equivalent diameter of 1.00 μm or less.

PRIOR ART DOCUMENT

Patent Document

Patent Document 1: JP 2007-125588 A
Patent Document 2: JP 2010-265523 A
Patent Document 3: JP 2011-184704 A

DISCLOSURE OF THE INVENTION

Problems to be Solved by the Invention

As a spring is strengthened, the resistance to hydrogen embrittlement is more likely to be reduced. Thus, a spring is required to have excellent resistance to hydrogen embrittlement even with high strength.

The present invention has been made in view of the foregoing circumstance, and it is a main object of the present invention to provide a method for manufacturing steel for a high-strength hollow spring that exhibits excellent resistance to hydrogen embrittlement. Furthermore, it is another object of the present invention to provide a method for manufacturing steel for a high-strength hollow spring that exhibits excellent fatigue resistance.

Means for Solving the Problems

The method for manufacturing steel for a hollow spring according to the present invention that can solve the above-mentioned problems lies in a method for manufacturing steel for a hollow spring obtained by quenching and tempering a seamless pipe for use as a material of the hollow spring, a steel composition of the seamless pipe including, in percent by mass, C: 0.35 to 0.5%, Si: 1.5 to 2.2%, Mn: 0.1 to 1%, Cr: 0.1 to 1.2%, Al: more than 0% and 0.1% or less, P: more than 0% and 0.02% or less, S: more than 0% and 0.02° or less, N: more than 0% and 0.02% or less, at least one element selected from the group consisting of V: more than 0% and 0.2% or less, Ti: more than 0% and 0.2% or less, and Nb: more than 0% and 0.2% or less, and at least one element selected from the group consisting of Ni: more than 0% and 1% or less, and Cu: more than 0% and 1% or less, wherein the quenching is performed to satisfy quenching conditions (1) mentioned below, and the tempering is performed to satisfy tempering conditions (2) mentioned below, (1) quenching conditions:

$$26000 \leq (T1+273) \times (\log(t1)+20) \leq 29{,}000$$

$$900^\circ\ \text{C.} \leq T1 \leq 1050^\circ\ \text{C.},$$

$$10\ \text{seconds} \leq t1 \leq 1{,}800\ \text{seconds}, \quad (1)$$

where T1 is a quenching temperature (° C.), and t1 is a holding time (seconds) in a temperature range of 900° C. or higher, and (2) Tempering Conditions:

$$13{,}000 \leq (T2+273) \times (\log(t2)+20) \leq 15{,}500$$

$$T2 \leq 550°\text{ C., and}$$

$$t2 \leq 3{,}600\text{ seconds,} \quad (2)$$

where T2 is a tempering temperature (° C.), and t2 is a total time (seconds) from start of heating to completion of cooling.

The hydrogen content in the steel may be controlled to be 0 ppm or more by mass and 0.16 ppm by mass or less.

Effects of the Invention

Effects obtained by the typical aspects of the present invention disclosed in the present application will be briefly described below. That is, the present invention constructed as mentioned above can manufacture steel for a high-strength hollow spring that exhibits excellent resistance to hydrogen embrittlement even with high strength.

BRIEF DESCRIPTION OF THE DRAWINGS

FIG. 1 is a schematic diagram showing an example of a heat pattern taken when manufacturing steel for a hollow spring in the present invention.

MODE FOR CARRYING OUT THE INVENTION

The inventors have conducted various studies by using seamless pipes. Specifically, these studies have been executed in terms of optimizing respective heat-treatment conditions for quenching and tempering to be performed on the obtained seamless pipes, and not in terms of improving the quality of a seamless pipe as a material as mentioned in Patent Documents 1 to 3. Consequently, it is found that when manufacturing steel for a hollow spring by quenching and tempering a seamless pipe that has its steel composition appropriately controlled, the quenching should be performed to satisfy the quenching conditions (1) below, and the tempering should be performed to satisfy the tempering conditions (2) below, where T1 is a quenching temperature (° C.); t1 is a holding time (seconds) in a temperature range of 900° C. or higher; T2 is a tempering temperature (° C.), and t2 is a total time (seconds) from start of heating to completion of cooling, and thereby achieving the desired objects of the present invention. Based on these findings, the present invention has been completed.

(1) quenching conditions:

$$26{,}000 \leq (T1+273) \times (\log(t1)+20) \leq 29{,}000$$

$$900°\text{ C. } T1 \leq 1{,}050°\text{ C.,}$$

$$10\text{ seconds} \leq t1 \leq 1{,}800\text{ seconds,} \quad \text{formula (1)}$$

(2) Tempering Conditions:

$$13{,}000 \leq (T2+273) \times (\log(t2)+20) \leq 15{,}500$$

$$T2 \leq 550°\text{ C., and}$$

$$t2 \leq 3{,}600\text{ seconds.} \quad \text{formula (2)}$$

Each of the terms "quenching temperature T1" and "tempering temperature T2" as used herein means the surface temperature of a workpiece. Furthermore, each of the terms "temperature range of 900° C. or higher", "heating start temperature", and "cooling completion temperature" also means the surface temperature of the workpiece. The surface temperature can be measured, for example, by a radiation thermometer, or by placing a thermocouple on the surface.

The term "quenching temperature" as used herein means a heating temperature (surface temperature) when quenching and hardening a seamless pipe.

First, the quenching conditions and tempering conditions which characterize the present invention will be described in detail below with reference to FIG. 1. Note that in FIG. 1, t2 shows a time between a heating start temperature of 200° C. and a cooling completion temperature of 200° C., based on examples to be mentioned later. However, the present invention is not limited thereto.

(1) Quenching Conditions:

The quenching conditions in the present invention are very important, particularly, to ensure the excellent resistance to hydrogen embrittlement even with high strength. It is supposed that quenching is performed under the quenching conditions specified by the present invention, thus accelerating the refinement of prior austenite grains, an increase in the area of prior austenite grain boundaries, and an increase in the amount of residual austenite, leading to the improvement of the durability, including embrittlement susceptibility to defects or hydrogen.

In the present invention, as specified by the formula (1) mentioned above, the quenching parameter of "(T1+273)×(log(t1)+20)" which is represented by the balance between the quenching temperature T1 and the holding time t1 (seconds) in a temperature range of 900° C. or higher as shown in FIG. 1, needs to satisfy the range of 26,000 or higher and 29,000 or lower. The formula (1) mentioned above is derived from various basic experiments under the following philosophy.

The tendency to accelerate the refinement of prior austenite grains, an increase in the area of prior austenite grain boundaries, and an increase in the amount of residual austenite after the quenching is preferable from the viewpoint of the resistance to hydrogen embrittlement. Meanwhile, during heating in the quenching, the tendency to accelerate the solid solution of carbides and to suppress the ferrite decarburization is preferable from the viewpoint of the resistance to hydrogen embrittlement. These factors are affected by both T1 and t1 mentioned above, and hence it is necessary to appropriately control the balance between T1 and t1. When taking into account the former requirements (the refinement of prior austenite grains, an increase in the area of prior austenite grain boundaries, and an increase in the amount of residual austenite), the quenching at a low temperature for a short period of time is considered to be preferable. On the other hand, from the viewpoint of accelerating the solid solution of carbides among the latter requirements (promotion of the solid solution of carbides and suppression of the ferrite decarburization), the quenching at a high temperature for a long period of time is considered to be preferable. Meanwhile, from the viewpoint of suppressing the ferrite decarburization, the quenching at a high temperature for a short period of time is considered to be preferable. Considering these comprehensively, the above-mentioned formula (1) is specified.

In the formula (1), the upper limit of the quenching parameter is preferably 28,700 or less, more preferably 28,500 or less, and still more preferably 28,300 or less. On the other hand, the lower limit of the quenching parameter is preferably 26,300 or more, and more preferably 26,500 or more.

In the present invention, the quenching needs to be performed to satisfy the formula (1) as well as the following ranges: 900° C.≤T1≤1,050° C. and 10 seconds≤t1≤1,800 seconds. That is, among the values T1 and t1 that can satisfy the range of the formula (1), the range of T1 and the upper limit of t1 are further limited to perform the quenching, thereby producing the desired steel for a high-strength hollow spring.

The lower limit of the quenching temperature T1 is 900° C. or higher. This value is set from the following viewpoint. The quenching temperature needs to be set to at least the $A_3$ point or higher; the $A_3$ point is a transformation temperature at which α (ferrite) is transformed into γ (austenite). In the component system of the present invention, the $A_3$ point is positioned at around 850° C. Note that in terms of accelerating the solid solution of the carbides as mentioned above, the quenching temperature should be higher. For this reason, the quenching temperature is set at the $A_3$ point+approximately 50° C. in many cases. Under such a thought, also in the present invention, the lower limit of the quenching temperature T1 is set at 900° C., which is determined by formula below: 850° C. ($A_3$)+50° C.=900° C. From the viewpoint of accelerating the solid solution of carbides and further suppressing the ferrite decarburization, the T1 is preferably 920° C. or higher, more preferably 925° C. or higher, and still more preferably 930° C. or higher. Meanwhile, even if the upper limit of the T1 is set high, there is no problem as long as the processing time is short. However, T1 should not be extremely high when taking into account the refinement of the prior austenite grains, the increase in the area of the prior austenite grain boundaries, and the increase in the amount of residual austenite. Accordingly, in the present invention, the upper limit of T1 is set at 1,050° C. or lower, preferably 1,020° C. or lower, and more preferably 1,000° C. or lower, and still more preferably 970° C. or lower.

The upper limit of the holding time t1 in the temperature range of 900° C. or higher is set at 1,800 seconds or less. The holding time t1 can also be said to be a duration in which the temperature of the workpiece is passes through a temperature range of 900° C. or higher. If the quenching is performed while controlling the T1 in the range of 900° C. or higher, the solid solution of carbides can progress even for a relatively short period of time. However, when taking into account the refinement of the prior austenite grains, the increase in the area of the prior austenite grain boundaries, and the increase in the amount of residual austenite, t1 should not be so long. Accordingly, the t1 is preferably 600 seconds or less, more preferably 300 seconds or less, and still more preferably 100 seconds or less. Note that although the lower limit of the t1 can be set within the range that satisfies both the formula (1) and the above-mentioned range of T1, the lower limit of t1 is 10 seconds or more when taking into account the actual operational level.

Here, the heat pattern in the above-mentioned "temperature range of 900° C. or higher" is not specifically limited as long as the quenching conditions (1) are satisfied. For example, suppose that as shown in FIG. 1, a heat pattern includes heating from 900° C. to T1 and then cooling from T1 to 900° C. The heating step may be performed at a certain average rate of temperature rise (e.g., 0.1 to 300° C./sec) such that the holding time t1 in a temperature range of 900° C. or higher satisfies the formula (1). The cooling step may be performed at a certain average rate of cooling (e.g., 0.1 to 300° C./sec). As illustrated in FIG. 1, the heat pattern may include an isothermal holding step of holding a constant temperature within a temperature range of 900° C. or higher for a certain period of time. For example, an isothermal holding step to hold a temperature in a range of 900 to 1,000° C. for 10 to 500 seconds may be included. These are examples of the pattern to which the present invention can be applied. In short, as long as the quenching conditions (1) are satisfied, various heat patterns can be adopted.

Furthermore, a heat pattern up to 900° C. is not also limited specifically. For example, as shown in FIG. 1, heating may be carried out from room temperature to 900° C. (further to T1) at the same average rate of temperature rise as that mentioned above. Alternatively, within the above-mentioned range of the average rate of temperature rise, the average rate of temperature rise may be set different depending on the temperature range, for instance, a temperature range from the room temperature to 900° C. and a temperature range from 900° C. to T1.

After heating in the way mentioned above, rapid cooling (or quenching) is performed. For example, cooling is preferably performed from 900 to 300° C. at an average cooling rate of approximately 20 to 1,000° C./sec.

(2) Tempering Conditions:

After quenching under the quenching conditions (1), tempering is performed. The tempering conditions specified by the present invention are very important, especially, in terms of ensuring excellent fatigue resistance. The tempering conditions specified by the present invention are used, thereby increasing both the strength of the hollow spring and the amount of residual austenite therein as well as appropriately controlling the size and existence form of tempered carbides. As a result, the durability, such as fatigue strength, of the hollow spring is supposed to improve.

In the present invention, as specified by the above-mentioned formula (2), the tempering parameter of "(T2+273)×(log(t2)+20)" which is represented by the balance between the tempering temperature T2 (° C.) and the total time t2 (seconds) from start of heating to completion of cooling as shown in FIG. 1, needs to satisfy the range of 13,000 or more and 15,500 or less. The above-mentioned formula (2) is derived from various basic experiments under the following philosophy.

In short, the term "total time t2 from the start of heating to the completion of cooling" as used herein means a total time spent by the tempering process. Specifically, this means the total period of time that is taken to heat from the "heating start" temperature (e.g., in a range of the room temperature to 200° C.) to the tempering temperature T2, and then to cool down to the "cooling completion" temperature (e.g. in a range of 200° C. to the room temperature). The reason why the present invention specifies the total time t2 spent by the tempering process as mentioned above rather a tempering time at the tempering temperature T2 is that the tempering behavior progresses by heating. Note that as long as the above-mentioned requirements are satisfied, a tempering holding time at the tempering temperature T2 is not particularly limited. The "cooling completion temperature" in the present invention is 200° C. That is, the "cooling completion" is defined as a state in which the surface temperature reaches 200° C. by cooling after heating up to the tempering temperature T2.

From the viewpoint of improving the strength and fatigue resistance, the tempering is preferably performed at a low temperature for a short period of time. Note that as the strength of the hollow spring becomes high, the seamless pipe tends to have its resistance to hydrogen embrittlement degraded. For this reason, considering these comprehensively, the upper limit and lower limit of the above-mentioned formula (2) are specified in order to exhibit the excellent fatigue resistance.

In the formula (2), the upper limit of the tempering parameter is preferably 15,200 or less, more preferably 15,000 or less, and still more preferably 14,700 or less. On the other hand, the lower limit of the tempering parameter is preferably 13,200 or more, more preferably 13,500 or more, and still more preferably 13,700 or more.

The upper limit of t2 is 3,600 seconds or less when taking into account the actual operational level. The upper limit of t2 is preferably 2,400 seconds or less. Note that the lower limit of t2 is not particularly limited as long as it satisfies the tempering conditions represented by the formula (2). However, when taking into account the actual operational level, the lower limit of t2 is preferably approximately 10 seconds or more.

The upper limit of T2 is 550° C. or lower. This is because as T2 is increased, the fatigue resistance or the like is degraded. The upper limit of T2 is preferably 500° C. or lower, and more preferably 450° C. or lower. The lower limit of T2 can be set to satisfy the range represented by the formula (2). However, when taking into consideration a decrease in the strength of the hollow spring, the lower limit of T2 is preferably 300° C. or higher, more preferably 325° C. or higher, and still more preferably 350° C. or higher.

The heat pattern on the tempering conditions in the present invention is not particularly limited as long as the above-mentioned requirements are satisfied. For example, suppose that a heat pattern includes heating from the room temperature to T2 and then cooling from T2 to the room temperature. An average rate of temperature rise in the heating step is preferably controlled to be, for example, in a range of 1 to 300° C./sec. The average cooling rate in the cooling step is preferably controlled to be, for example, in a range of 1 to 1,000° C./sec. As illustrated in FIG. 1, apart of the heat pattern may include an isothermal holding step of holding a constant temperature for a certain period of time. For example, an isothermal holding step to hold the constant temperature as the T2 for 0 to 2,000 seconds may be included. When T2 is in a range of 200 to 450° C., T2 is preferably held at a constant temperature for 10 to 2,000 seconds. These are examples of the pattern to which the present invention can be applied. In short, as long as the tempering conditions (2) are satisfied, various heat patterns can be adopted.

The quenching conditions and tempering conditions featuring the present invention have been described above in detail.

The composition of the steel in the seamless pipe used as the material will be described. The composition of the steel in the seamless pipe in the present invention is within a range normally used for a hollow spring. The reason for limiting the chemical components will be described below.

[C: 0.35 to 0.5%]

Carbon (C) is an element required to ensure the strength of the steel. The lower limit of the C content is set at 0.35% or more. Thus, the lower limit of the C content is preferably 0.37% or more, and more preferably 0.40% or more. However, any excessive C content degrades the ductility of the steel. Thus, the upper limit of the C content is set at 0.5% or less. The upper limit of the C content is preferably 0.48% or less, and more preferably 0.47% or less.

[Si: 1.5 to 2.2%]

Silicon (Si) is an element effective in exhibiting the fatigue resistance required for springs. To ensure setting resistance required for a high-strength spring, the lower limit of the Si content is set at 1.5% or more. The lower limit of the Si content is preferably 1.6% or more, and more preferably 1.7% or more. However, Si is an element that accelerates decarburization. Any excessive Si content disadvantageously accelerates the formation of a decarburized layer on a steel surface. Thus, the upper limit of the Si content is set at 2.2% or less. The upper limit of the Si content is preferably 2.1% or less, and more preferably 2.0% or less.

[Mn: 0.1 to 1%]

Manganese (Mn) is used as a deoxidizing element while having effect to render harmful element sulfur (S) harmless by binding with S to form MnS. To effectively exhibit these effects, the lower limit of Mn content is set at 0.1% or more. The lower limit of the Mn content is preferably 0.15% or more, and more preferably 0.2% or more. However, any excessive Mn content forms segregation zones in the steel, which leads to variations in the quality of material. Thus, the upper limit of the Mn content is set at 1% or less. The upper limit of the Mn content is preferably 0.9% or less, and more preferably 0.8% or less.

[Cr: 0.1 to 1.2%]

Chromium (Cr) is an element effective in ensuring the strength of steel after the tempering and improving the corrosion resistance of steel. Thus, Cr is very important, particularly, for suspension springs that are required to demonstrate the high-level corrosion resistance. To effectively exhibit these effects, the lower limit of the Cr content is set at 0.1% or more. The lower limit of the Cr content is preferably 0.15% or more, and more preferably 0.2% or more. However, any excessive Cr content tends to easily generate a supercooled tissue and cause enrichment of Cr in cementite, reducing the plastic deformability of the steel, thus leading to degradation in the cold forgeability thereof. Furthermore, any excessive Cr content tends to easily form Cr carbides that are different from cementite, thus worsening the balance between the strength and ductility. Thus, the upper limit of Cr content is set at 1.2% or less. The upper limit of the Cr content is preferably 1.1% or less, and more preferably 1.0% or less.

[Al: More than 0% and 0.1% or Less]

Aluminum (Al) is added mainly as a deoxidizing element. Al binds with N to form AlN, thereby rendering solid-solution N harmless, while contributing to refining the microstructure of the steel. To effectively exhibit these effects, the lower limit of the Al content is preferably set at 0.005% or more, and more preferably 0.01% or more. However, since Al is a decarburization accelerating element, like Si, if the Si content is large, the addition of an abundance of Al needs to be avoided. Thus, the upper limit of the Al content is set at 0.1% or less. The upper limit of the Al content is preferably 0.07% or less, and more preferably 0.05% or less.

[P: More than 0% and 0.02% or Less]

Phosphorus (P) is a harmful element that degrades the toughness and ductility of the steel. For this reason, it is very important to reduce the P content. Thus, the upper limit of the P content is set at 0.02% or less. The upper limit of the P content is preferably 0.017% or less, and more preferably 0.015% or less. Note that P is an impurity inevitably contained in the steel, and hence the P content is difficult to set at 0% in terms of industrial production.

[S: More than 0% and 0.02% or Less]

Like P mentioned above, sulfur (S) is a harmful element that degrades the toughness and ductility of the steel. For this reason, it is very important to reduce the S content.

Thus, the upper limit of the S content is set at 0.02% or less. The upper limit of the S content is preferably 0.017% or less, and more preferably 0.015% or less. Note that S is an impurity inevitably contained in the steel, and hence the S content is difficult to set at 0% in terms of industrial production.

[N: More than 0% and 0.02% or Less]

Nitrogen (N) has an effect of refining the microstructure of the steel by forming a nitride in the presence of Al, Ti, and the like. To effectively exhibit this effect, the lower limit of the N content is preferably set at 0.001% or more, and more preferably 0.002% or more. Note that the presence of N in a solid-solution state degrades the toughness, ductility, and resistance to hydrogen embrittlement of the steel. Therefore, the upper limit of N content is set at 0.02°. The upper limit of the N content is preferably 0.01% or less, and more preferably 0.007% or less.

[At Least One Element Selected from the Group Consisting of V: More than 0% and 0.2% or Less, Ti: More than 0% and 0.2% or Less, and Nb: More than 0% and 0.2% or Less]

Vanadium (V), Titanium (Ti), and Niobium (Nb) bind with C, N, S, etc. to form precipitates, such as carbides, nitrides, carbonitrides, and sulfides, thereby rendering these elements harmless, such as C, N, and S. Such formation of the precipitates also exhibits the effect of refining an austenite microstructure during heating in an annealing step of a manufacturing procedure for a seamless pipe, or in a quenching step of a manufacturing procedure for a spring. Furthermore, these elements also have the effect of improving the delayed fracture resistance of the steel. These elements may be used alone or in combination. To effectively exhibit these effects, the lower limit of the content of at least one of Ti, V, and Nb (which means the content of a single element when only one of them is included, or the total content of two or more elements when two or more of them are included, and note that the same goes for the following cases) is preferably 0.01% or more. However, any excessive content of the above-mentioned element(s) forms coarse carbides, nitride, etc., leading to degradation in the toughness and ductility of the steel in some cases. The upper limit of the content of the above-mentioned element(s) is set at 0.2% or less. The upper limit of the above-mentioned element(s) is preferably 0.18% or less, and more preferably 0.15% or less.

[At Least One Element Selected from the Group Consisting of Ni: More than 0% and 1% or Less, and Cu: More than 0% and 1% or Less]

Nickel (Ni) and copper (Cu) are elements that are effective in suppressing the decarburization of a surface layer and improving the corrosion resistance of the steel. These elements may be used alone or in combination.

Among them, Ni may not need to be added when taking into account the cost reduction. Thus, the lower limit of the Ni content is not particularly limited. To effectively exhibit the above-mentioned effect by the addition of Ni, the lower limit of the N content is preferably set at 0.2% or more. Note that any excessive Ni content generate a supercooled tissue in a rolled material and leaves residual austenite after the quenching, thereby degrading the fatigue resistance and the like in some cases. Thus, the upper limit of the Ni content is set at 1% or less. Further, when taking into consideration the cost reduction and the like, the upper limit of the Ni content is preferably 0.8% or less, and more preferably 0.6% or less.

To effectively exhibit the above-mentioned effect by the addition of Cu, the lower limit of the C content is preferably set at 0.2% or more. Note that like Ni, any excessive Cu content generates the supercooled tissue, causing cracks during hot working in some cases. Thus, the upper limit of the Cu content is set at 1% or less. Further, when taking into consideration the cost reduction, the upper limit of the Cu content is preferably 0.8% or less, and more preferably 0.6% or less.

The basic components of the seamless pipe used in the present invention have been mentioned above, with the balance being iron and inevitable impurities. Examples of the inevitable impurities can include Sn and As. The smaller the content of the inevitable impurity, the better the steel of the seamless pipe normally becomes, for example, like P and S. For this reason, particularly, even some inevitable impurities have the upper limits of their contents additionally specified as mentioned above. Thus, the term "inevitable impurity" as used herein, which configures the balance, is defined as another element other than the element, an upper limit of whose content is specified as mentioned above in terms of concept.

The method for manufacturing steel for a hollow spring according to the present invention involves performing (1) quenching and (2) tempering on a seamless pipe with a predetermined composition, as mentioned above. Other steps are not particularly limited, and a normal method can be adopted therefor. Now, a description will be given on the preferable method for manufacturing steel for a hollow spring.

First, steel with the predetermined composition is smelted by a normal smelting method, followed by cooling (i.e., casting) an obtained molten steel.

Thereafter, blooming is performed on the steel. The heating temperature for the blooming is preferably in a range of, for example, 1,100 to 1,300° C.

Then, a slab obtained by the above-mentioned blooming is subjected to hot forging to be formed into a round bar. The heating temperature for the hot forging is preferably in a range of, for example, 1,000 to 1,200° C.

Thereafter, the seamless pipe may be produced by the known method. For instance, after the hot forging, the round bar is formed into a predetermined shape by using the known piercing method, followed by hot extrusion, cooling, cold working, annealing, pickling, and if necessary, polishing of an inner surface layer and cold working, thereby producing a seamless pipe.

Among the above-mentioned steps, the annealing after the cold working is preferably performed by heating up to a temperature range of $A_3$ point or higher and 1,000° C. or lower. The holding time in the temperature range of $A_3$ point or higher, that is, the total time after the start of heating at the temperature of $A_3$ point or higher until when the temperature of $A_3$ point is reached by cooling is preferably controlled to be five minutes or less. In this way, the holding time is controlled within the above-mentioned range, so that the occurrence of decarburization during annealing and the like is suppressed, and carbides are refined, thereby making it possible to improve the fatigue properties.

Here, the $A_3$ point can be determined as follows. Note that [ ] in the formula below indicates % by mass. For example, [C] means the C content in % by mass.

$$A_3=894.5-269.4\times[C]+37.4\times[Si]-31.6\times[Mn]-19.0\times[Cu]-29.2\times[Ni]-11.9\times[Cr]+19.5\times[Mo]+22.2\times[Nb]$$

The annealing after the above-mentioned cold working is preferably performed in an inert or reducing gas atmosphere. Such control of the annealing atmosphere can suppress the occurrence of decarburization in annealing. Furthermore, the generation of scales during annealing can be suppressed, which can omit a pickling step.

The pickling time in manufacturing the seamless pipe is preferably controlled to be 30 minutes or less, or alternatively the pickling itself is preferably omitted. In this way, the hydrogen content in the seamless pipe can be reduced, whereby the hydrogen content after the tempering and quenching can also be reduced.

After producing the seamless pipe in the way above, in a spring formation procedure, such as hot forming or cold forming, the quenching process and tempering process are performed to obtain the steel for a hollow spring. In the case of the hot forming, after producing the seamless pipe, the quenching under the conditions (1) is performed. At this time, during heating for the quenching, spring forming is also performed, and then the tempering is performed under the conditions (2). On the other hand, in the case of the cold forming, after producing the seamless pipe, the quenching under the conditions (1) and the tempering under the conditions (2) are performed, and then spring forming is performed without heating.

Furthermore, the hydrogen content in the steel for a hollow spring obtained by the manufacturing method according to the present invention is preferably controlled to be 0 ppm by mass or more and 0.16 ppm by mass or less.

Since shot-peening cannot be applied to the inner peripheral surface of the hollow spring as mentioned above, there are strict requirements for the durability of hollow springs, regarding the embrittlement susceptibility to defects or hydrogen. Even a small amount of hydrogen in the steel for a hollow spring significantly affects the durability of the spring. Thus, the upper limit of the hydrogen content is preferably 0.16 ppm or less by mass. Consequently, as shown in Examples to be mentioned later, the very high fatigue resistance can be achieved. Therefore, the smaller the hydrogen content, the better the quality of the steel for a hollow spring becomes. The upper limit of the above-mentioned hydrogen content is preferably 0.15 ppm or less by mass, and more preferably 0.14 ppm or less by mass.

A method for reducing the hydrogen content in the steel for a hollow spring is well known. Even in the present invention, the method conventionally used can be selected and applied as appropriate. In a specific example of the reducing method of the hydrogen content in the steel, for example, a pickling time in a seamless pipe production step is shorten to approximately 30 minutes or less. Alternatively, pickling itself may be omitted. Alternatively, a dehydrogenation process may be performed after the quenching and tempering in manufacturing the steel for a hollow spring. The dehydrogenation process can be performed, for example, by applying heat treatment at 300° C. or lower.

The method for manufacturing steel for a hollow spring according to the present invention has been described above.

The steel for a hollow spring obtained in this way is used and finally subjected to processes, including setting and shot-peening, thereby producing a hollow spring. Note that when performing the cold forming as mentioned above, the spring forming may be performed on the steel for a spring, and then setting and shot-peening may be performed thereon.

Examples of the hollow spring include a valve spring, a clutch spring, and a suspension spring. The hollow spring is suitable for use in the engines, clutches, suspensions of automobiles, and the like.

EXAMPLES

The present invention will be more specifically described below by way of Examples, but is not limited to the following Examples. Various modifications and changes can be made to these examples as long as they are adaptable to the above-mentioned and below-mentioned concepts, and they are included within the technical scope of the present invention.

As mentioned above, the most characteristic aspect of the present invention is that a predetermined heat treatment is applied to a seamless pipe. The inner peripheral surface or outer peripheral surface of the seamless pipe subjected to the heat treatment has substantially the same surface texture as an outer peripheral surface of a solid steel material subjected to the heat treatment. Thus, the presence or absence of the effects of the present invention is not linked to the shape of the material. Therefore, in Examples 1 and 2 mentioned below, not the seamless pipe, but the solid steel material was used. Respective heat treatments of the quenching and tempering specified by the present invention were applied to the steel material, which was then evaluated.

Example 1

In this example, to clarify the influences of the quenching and tempering conditions, especially, on the hydrogen embrittlement susceptibility, experiments were conducted in the following way. Here, a steel No. Al shown in Table 1, which was a medium carbon steel satisfying the requirement of the present invention, was used.

First, after smelting the steel by a normal smelting method, the obtained molten steel was cooled (i.e., casted), and then subjected to blooming by heating to 1,100 to 1,300° C., thereby producing a slab with a cross-sectional shape of 155 mm×155 mm. Then, the hot forging was performed on the slab on a heating condition, namely, at 1,000 to 1,200° C., thereby forming a round bar with a diameter of 150 mm. Then, the hot forging was further performed by heating on a heating condition, namely, at 1,000 to 1,200° C., thereby producing a round bar with a diameter of 15 mm.

TABLE 1

| Steel | Chemical composition* (% by mass) | | | | | | | | | | | |
|---|---|---|---|---|---|---|---|---|---|---|---|---|
| type | C | Si | Mn | Cr | Al | P | S | N | V | Ti | Ni | Cu |
| A1 | 0.43 | 1.90 | 0.21 | 0.95 | 0.0350 | 0.007 | 0.007 | 0.0040 | 0.145 | 0.080 | 0.60 | 0.31 |

*Balance: Iron and inevitable impurities other than P and S

The round bars obtained in this way were subjected to various quenching and tempering processes shown in Table 2, thereby cutting out flat-shaped specimens, each having 10 mm width×1.5 mm thickness×65 mm length. Each flat-shaped specimen was used and evaluated for the resistance to hydrogen embrittlement and Vickers hardness in the following way.

In detail, the conditions for the quenching and tempering were as follows. The steel round bar was heated at an average rate of temperature rise of 10° C./sec in a temperature range from the room temperature to T1, and then held at T1 for a predetermined time. Then, the steel bar was cooled at an average cooling rate of 50° C./sec in a temperature range from T1 to 300° C. At this time, the holding time at T1 was changed such that the holding time t1 at 900° C. or higher was 600 seconds.

Subsequently, the steel bar was cooled down to 200° C., and then subjected to the tempering. Specifically, the steel bar was heated at an average rate of temperature rise of 10° C./sec in a temperature range from 200° C. to T2, and then held at T2 for a predetermined time. Then, the steel bar was cooled at an average cooling rate of 300° C./sec in a temperature range from T2 to 200° C. At this time, the holding time at T2 was changed such that t2 (the time after heating to 200° C. or higher before cooling to 200° C. or lower) was 2,400 seconds.

(Evaluation on Resistance to Hydrogen Embrittlement)

Each specimen, which was obtained as mentioned above, with a stress of 1,400 MPa applied thereto by four point bending was immersed in 1 L of a mixed solution that contained 0.5 mol of sulfuric acid and 0.01 mol of potassium thiocyanate. A voltage of −700 mV, which was lower than a saturated calomel electrode (SCE), was applied to the specimen by using a potentiostat, and a time (fracture time) until a crack occurred was measured. In this example, specimens having a fracture lifetime of 1,000 seconds or more were rated as "pass".

(Vickers Hardness)

The plate-shaped specimen was embedded in resin such that its cross-section in the width-thickness direction was exposed, followed by polishing and mirror-finish. Then, a Vickers hardness (Hv) of the specimen was measured by applying a load of 500 g to the position located at the center in the depth direction from the surface layer of the specimen. In this example, specimens having a Vickers hardness of 550 Hv or higher were rated as having a high strength. These results of the evaluation are shown together in Table 2.

TABLE 2

| | Quenching conditions (1) | | | Tempering conditions (2) | | | Resistance to hydrogen embrittlement | Strength |
|---|---|---|---|---|---|---|---|---|
| Specimen No. | Temperature T1 (° C.) | Time t1 (seconds) | Quenching parameter | Temperature T2 (° C.) | Time t2 (seconds) | Tempering parameter | Fracture lifetime (seconds) | Vickers hardness (Hv) |
| 1 | 900 | 600 | 26,719 | 300 | 2,400 | 13,397 | 1,186 | 627.0 |
| 2 | 900 | 600 | 26,719 | 325 | 2,400 | 13,981 | 1,659 | 621.8 |
| 3 | 900 | 600 | 26,719 | 350 | 2,400 | 14,566 | 1,300 | 616.5 |
| 4 | 900 | 600 | 26,719 | 375 | 2,400 | 15,150 | 1,375 | 611.3 |
| 5 | 900 | 600 | 26,719 | 400 | 2,400 | 15,735 | 990 | 582.0 |
| 6 | 900 | 600 | 26,719 | 425 | 2,400 | 16,319 | 1,372 | 540.5 |
| 7 | 900 | 600 | 26,719 | 450 | 2,400 | 16,904 | 1,337 | 506.0 |
| 8 | 925 | 600 | 27,288 | 300 | 2,400 | 13,397 | 1,800 | 625.3 |
| 9 | 925 | 600 | 27,288 | 325 | 2,400 | 13,981 | 1,390 | 620.0 |
| 10 | 925 | 600 | 27,288 | 350 | 2,400 | 14,566 | 1,799 | 618.3 |
| 11 | 925 | 600 | 27,288 | 375 | 2,400 | 15,150 | 1,609 | 599.0 |
| 12 | 925 | 600 | 27,288 | 400 | 2,400 | 15,735 | 888 | 582.0 |
| 13 | 925 | 600 | 27,288 | 425 | 2,400 | 16,319 | 1,501 | 533.5 |
| 14 | 925 | 600 | 27,288 | 450 | 2,400 | 16,904 | 1,465 | 507.3 |
| 15 | 1,025 | 600 | 29,566 | 300 | 2,400 | 13,397 | 914 | 614.8 |
| 16 | 1,025 | 600 | 29,566 | 325 | 2,400 | 13,981 | 980 | 607.8 |
| 17 | 1,025 | 600 | 29,566 | 350 | 2,400 | 14,566 | 918 | 609.5 |
| 18 | 1,025 | 600 | 29,566 | 375 | 2,400 | 13,150 | 880 | 599.0 |
| 19 | 1,025 | 600 | 29,566 | 400 | 2,400 | 15,735 | 350 | 583.8 |
| 20 | 1,025 | 600 | 29,566 | 425 | 2,400 | 16,319 | 570 | 533.3 |
| 21 | 1,025 | 600 | 29,566 | 450 | 2,400 | 16,904 | 1,297 | 509.8 |

Specimen Nos. 1 to 4 and 8 to 11 shown in Table 2 are examples in which the steels satisfying the requirements of the present invention were used to perform the quenching (1) and tempering (2) specified by the present invention. All these specimens had a long fracture lifetime of 1,000 seconds or more, though they had high strength. Thus, such specimens had excellent resistance to hydrogen embrittlement.

In contrast, the specimen Nos. 5 to 7 are examples in which the same quenching conditions were used and their respective tempering parameters exceeded the upper limit of the tempering parameter specified by the formula (2). The numerical value of the tempering parameter was increased from the specimen No. 5 to the specimen Nos. 6 and No. 7 in this order. The specimen No. 5 that had its tempering parameter slightly exceeding the upper limit thereof had adequate hardness, but a short fracture lifetime. On the other hand, in each of the specimen Nos. 6 and 7, as the numerical value of the tempering parameter was increased, the hardness of the steel was reduced, but the fracture lifetime was not less than 1,000 seconds, which was specified by the present invention.

The same tendency as those observed in the specimen Nos. 5 to No. 7 were also recognized in specimen Nos. 12 to 14. That is, the specimen Nos. 12 to 14 are other examples in which the same quenching conditions were used and their respective tempering parameter exceeded the upper limit of the tempering parameter specified by the formula (2). The numerical value of the tempering parameter was increased from the specimen No. 12 to the specimen No. 13 and the specimen No. 14 in this order. The specimen No. 12 that had its tempering parameter slightly exceeding the upper limit thereof had adequate hardness, but a short fracture lifetime. On the other hand, in each of the specimen Nos. 12 and 13, as the numerical value of the tempering parameter was increased, the hardness of the steel was reduced, but the fracture lifetime was not less than 1,000 seconds which was specified by the present invention.

As can be seen from these results, the upper limit of tempering parameter was found to be a very important factor that ensures the desired high strength and the properties of the resistance to hydrogen embrittlement. Therefore, it was confirmed that only by controlling the upper limit of the tempering parameter within the range specified by the present invention, the above-mentioned desired properties were exhibited.

The specimen Nos. 15 to 21 are examples in which the same quenching conditions were used and their respective tempering parameters slightly exceeded the upper limit of the quenching parameter specified by the formula (1).

Among the specimens mentioned above, the specimen Nos. 15 to 18 are examples in which the tempering conditions (2) specified by the present invent ion were used in the manufacturing procedure. However, the quenching parameter of each of these specimens exceeded the upper limit thereof, resulting in a short fracture lifetime.

On the other hand, the specimen Nos. 19 to 21 are examples in which their tempering parameters exceeded the upper limit of the tempering parameter specified by the formula (2). The numerical value of the tempering parameter was increased from the specimen No. 19 to the specimen Nos. 20 and No. 21 in this order. The specimen No. 19 that had its tempering parameter slightly exceeding the upper limit thereof had adequate hardness, but a short fracture lifetime. On the other hand, in each of the specimen Nos. 20 and 21, as the numerical value of the tempering parameter was increased, the hardness of the steel was reduced, but the fracture lifetime was increased. In the specimen No. 21, the fracture lifetime was not less than 1,000 seconds specified by the present invention, and the resistance to hydrogen embrittlement was improved.

As can be seen from these results, the upper limit of quenching parameter was found to be a very important factor that ensures the desired resistance to hydrogen embrittlement. Therefore, it was confirmed that if the upper limit of the quenching parameter does not satisfy the range of the present invention, the desired properties cannot be obtained.

Example 2

In this example, particularly, to clarify the influences of the quenching and tempering conditions on the fatigue resistance, experiments were conducted using the round bar produced in Example 1 in the following way.

(Evaluation on Fatigue Resistance)

After performing the quenching and tempering on the round bars under various conditions mentioned in Table 3, each round bar was processed to produce a specimen in conformity with JIS standard (a specimen for a fatigue test in accordance with JIS Z2274). Then, the rotational bending fatigue test was performed on the specimen at a rotational speed of 3000 rpm with a stress of 900 MPa applied thereto. The details of the quenching and tempering conditions were the same as those mentioned in Example 1. In this example, specimens in which the number of cycles that caused failure was 100,000 or more were rated as "pass".

These results of the evaluation are shown together in Table 3. The specimen Nos. 10 and 17 shown in Table 3 corresponded to the specimen Nos. 10 and 17 shown in Table 2, respectively. Further, the specimen Nos. 10 and 17 in Table 3 had the same heat treatment conditions as the specimen Nos. 10 and No. 17 in Table 2, respectively.

TABLE 3

| | Quenching conditions (1) | | | Tempering conditions (2) | | | Fatigue resistance Number of |
|---|---|---|---|---|---|---|---|
| Specimen No. | Temperature T1 (° C.) | Time t1 (seconds) | Quenching parameter | Temperature T2 (° C.) | Time t2 (seconds) | Tempering parameter | cycles to failure (cycles) |
| 10 | 925 | 600 | 27,288 | 350 | 2,400 | 14,566 | 161,500 |
| 22 | 925 | 600 | 27,288 | 430 | 2,400 | 16,436 | 62,100 |
| 17 | 1,025 | 600 | 29,566 | 350 | 2,400 | 14,566 | 594,400 |
| 23 | 1,025 | 600 | 29,566 | 430 | 2,400 | 16,436 | 62,100 |

First, the specimen No. 10 will be compared with the specimen No. 17. These specimens are examples in which the tempering was performed on the same tempering conditions, which were specified by the present invention, but these specimens differ from each other in the quenching conditions. The specimen No. 10 was the example that satisfied the quenching conditions specified by the present invention, while the specimen No. 17 was the example in which its quenching parameter slightly exceeded the upper limit of the quenching parameter specified by the present invention.

As shown in Table 3, when focusing on only the fatigue resistance, a difference in the quenching condition did not lead to a different evaluation result in terms of the fatigue resistance. Even if the quenching was performed with its parameter exceeding the upper limit of the quenching parameter, like the specimen No. 17, the adequate fatigue resistance was obtained in the same manner as when the quenching conditions specified by the present invention were used, like the specimen No. 10. Note that as shown in Table 2 mentioned above, in the specimen No. 17, its tempering parameter exceeded the upper limit of the tempering parameter, thus decreasing the fracture lifetime. To satisfy the desired resistance to hydrogen embrittlement and high-strength, it is confirmed that the achievement of both the quenching condition and tempering condition specified by the present invention is essential.

Next, the specimen No. 22 will be compared with the specimen No. 23. These specimens are examples in which the tempering was performed on the same tempering conditions, but their tempering parameters exceeded the tempering parameter specified by the present invention. Furthermore, these specimens differ from each other in the quenching conditions. The specimen No. 22 was the example that satisfied the quenching conditions specified by the present invention, while the specimen No. 23 was the example in which its quenching parameter slightly exceeded the upper limit of the quenching parameter specified by the present invention.

As shown in Table 3, both the specimen Nos. 22 and 23 deviated from the tempering conditions specified by the present invention, thus leading to degradation in the fatigue resistance. Thus, when focusing on only the fatigue resistance, a difference in the quenching condition did not lead to a different evaluation result in terms of a criterion of the fatigue resistance. For instance, even if the quenching was performed with its parameter exceeding the upper limit of the quenching parameter, like the specimen No. 23, the fatigue resistance was degraded in the same manner as when the quenching conditions specified by the present invention were used, like the specimen No. 22.

Example 3

In this example, to clarify the influences of the tempering conditions, especially, on the fatigue resistance by using the steel for a hollow spring, seamless pipes were produced in the following way. Then, the hydrogen content in the steel of each seamless pipe was measured, and the fatigue resistance of the steel was evaluated.

(Measurement of Hydrogen Content in Steel)

The round bar with a diameter of 150 mm produced in Example 1 mentioned above was used and machined to produce an extrusion billet, followed by hot extrusion at 1,100° C. as a heating condition, thus producing an extrusion tube with an outer diameter of 54 mm and an inner diameter of 37 mm. Then, after cold working (in detail, drawing process: non-continuous draw bench, rolling process: Pilger rolling mill), annealing was performed on the tube at a temperature of 920 to 1,000° C. for a total heating time of 20 minutes or less, the total heating time being measured at the temperature of 900° C. or higher. Subsequently, to adjust the hydrogen content in the steel for each tube, the pickling was performed by changing the pickling time for the corresponding tube. Specifically, the pickling process was performed by pickling the steel tube in a pickling solution of 5 to 10° hydrochloric acid for 10 to 30 minutes. Then, the cycle of cold working, annealing, and pickling was repeated a plurality of times, thereby producing a seamless pipe with an outer diameter of 16 mm and an inner diameter of 8.0 mm.

The seamless pipe obtained in this way was subjected to the quenching process and the tempering process. The detailed conditions for the quenching and tempering were as follows. First, the seamless pipe was heated at an average rate of temperature rise of 100° C./sec in a temperature range from the room temperature to T1, and then held at T1 for a predetermined time. Then, the seamless pipe was cooled at an average cooling rate of 50° C./sec in a temperature range from T1 to 300° C. At this time, the holding time at T1 was changed such that the holding time t1 at 900° C. or higher was 60 seconds.

Subsequently, after being cooled to 200° C., the seamless pipe was subjected to the tempering. Specifically, the seamless pipe was heated at an average rate of temperature rise of 10° C./sec in a temperature range from 200° C. to T2, and then held at T2 for a predetermined time. Subsequently, the seamless pipe was cooled at an average cooling rate of 300° C./sec in a temperature range from T2 to 200° C. At this time, the holding time at T2 was changed such that t2 (the time after heating to 200° C. or higher before cooling to 200° C. or lower) was 2,400 seconds.

In this way, a ring-shaped specimen with a width of 1 mm was cut out of the obtained steel for a hollow spring, and then the amount of discharged hydrogen from the specimen was measured. The amount of discharged hydrogen was measured through temperature elevation analysis by an atmospheric pressure ionization mass spectrometry (APIMS). Here, the rate of temperature rise was set at 720° C./hr, and the hydrogen content in the steel was defined as the amount of discharged hydrogen until 720° C.

(Measurement of Fatigue Resistance)

The steel for a hollow spring of each specimen was used and evaluated for the fatigue resistance. In this example, a torsion fatigue test was performed on the steel at a load stress of 735±600 MPa. Specimens having the number of cycles to failure of 50,000 or more were rated as having excellent fatigue resistance.

These results of this evaluation are shown in Table 4.

TABLE 4

| | Quenching conditions (1) | | | Tempering conditions (2) | | | Hydrogen | Fatigue resistance Number of |
|---|---|---|---|---|---|---|---|---|
| Specimen No. | Temperature T1 (° C.) | Time t1 (seconds) | Quenching parameter | Temperature T2 (° C.) | Time t2 (seconds) | Tempering parameter | content in steel (ppm) | cycles to failure (cycles) |
| 1 | 1,020 | 60 | 28,159 | 350 | 2,400 | 14,566 | 0.16 | 297,000 |
| 2 | 1,020 | 60 | 28,159 | 350 | 2,400 | 14,566 | 0.18 | 70,700 |
| 3 | 1,020 | 60 | 28,159 | 390 | 2,400 | 15,501 | 0.15 | 37,400 |
| 4 | 1,020 | 60 | 28,159 | 390 | 2,400 | 15,501 | 0.26 | 30,200 |

In the specimen Nos. 1 to 4 shown in Table 4, all their quenching conditions were the same, and the quenching was performed on the conditions specified by the present invention. However, the specimens differed from one another in the tempering conditions. The specimen Nos. 1 and 2 are the examples in which the tempering conditions specified by the present invention were used. The specimen Nos. 3 and 4 are the examples in which their tempering parameters slightly exceeded the upper limit of the tempering parameter specified by the present invention.

When comparing between the specimen Nos. 1 and No. 2, in the specimen No. 1, a hydrogen content in the steel was controlled to be 0.16 ppm by mass, which was the preferable upper limit specified by the present invention, whereas in the specimen No. 2, a hydrogen content was not controlled to be the upper limit. Thus, the specimen No. 1 achieved the significantly large number of cycles to failure and exhibited the extremely high fatigue resistance, compared to the specimen No. 2.

In contrast, when the tempering was performed with its tempering parameter slightly exceeding by only 1 the upper limit thereof (15,500) specified by the present invention, like the specimen Nos. 3 and No. 4, the number of cycles to failure was decreased. Even if the hydrogen content in the steel was controlled to be the preferable upper limit, like the specimen No. 3, the number of cycles to failure could not reach 50,000, which was a criterion for "pass".

As can be seen from these results, it was confirmed that to ensure the fatigue resistance of the hollow spring, it is very important to appropriately control, especially, the tempering conditions. When controlling the upper limit of the hydrogen content in the steel within a preferable range, in addition to the tempering process on the tempering conditions specified by the present invention, it was found that the fatigue resistance was improved drastically.

In Example 3, the fracture lifetime serving as an index of the resistance to hydrogen embrittlement was not measured. However, since the specimen Nos. 1 and 2 satisfied the quenching conditions (1), it is considered that the specimen Nos. 1 and 2 achieved the adequate resistance to hydrogen embrittlement.

The present application claims priority to Japanese Patent Application No. 2014-222840, filed on Oct. 31, 2014, the disclosure of which is incorporated herein by reference in its entirety.

The invention claimed is:

1. A method for manufacturing steel, the method comprising:

quenching and tempering a seamless pipe comprising a steel composition comprising, in percent by mass:

C: 0.35 to 0.5%,

Si: 1.5 to 2.2%,

Mn: 0.1 to 1%,

Cr: 0.1 to 1.2%,

Al: more than 0% and 0.1% or less,

P: more than 0% and 0.02% or less,

S: more than 0% and 0.02% or less,

N: more than 0% and 0.02% or less, at least one element selected from the group consisting of V: more than 0% and 0.2% or less, Ti: more than 0% and 0.2% or less, and Nb: more than 0% and 0.2% or less, and at least one element selected from the group consisting of Ni: more than 0% and 1% or less, and Cu: more than 0% and 1% or less, wherein the quenching is performed to satisfy quenching conditions (1), and the tempering is performed to satisfy tempering conditions (2), (1) quenching conditions:

$$26{,}000 \leq (T1+273)\times(\log(t1)+20) \leq 29{,}000$$

$$900^\circ\ \text{C.} \leq T1 \leq 1{,}050^\circ\ \text{C., and}$$

$$10\ \text{seconds} \leq t1 \leq 1{,}800\ \text{seconds,} \qquad \text{formula (1)}$$

wherein

T1 is a quenching temperature by ° C., t1 is a duration time in quenching by seconds, which is timed starting at a moment when the pipe reaches 900° C. and ending at a moment when the pipe reaches 900° C. after the pipe is held at the quenching temperature T1 for a quenching holding time, when the quenching temperature T1 is 900° C., the duration time t1 equals to the quenching holding time, and when the quenching temperature T1 is higher than 900° C., the duration time t1 is greater than the quenching holding time; and (2) tempering conditions:

$$13{,}000 \leq (T2+273)\times(\log(t2)+20) \leq 15{,}500 \qquad \text{formula (2)}$$

$$T2 \leq 550^\circ\ \text{C., and}$$

$$t2 \leq 3{,}600\ \text{seconds,}$$

wherein

T2 is a tempering temperature by ° C., and t2 is a total time in tempering by seconds, which is timed starting at a moment when the pipe reaches a heating start temperature and ending at a moment when the pipe reaches a cooling completion temperature after the pipe is held at the tempering temperature T2 for a tempering holding time.

2. The method according to claim 1, wherein the hydrogen content in the steel is controlled to be 0 ppm or more by mass and 0.16 ppm by mass or less.

3. The method according to claim 1, wherein the tempering conditions (2) are:

$$13{,}000 \leq (T2+273)\times(\log(t2)+20) \leq 15{,}200$$

$$T2 \leq 550^\circ\ \text{C., and}$$

$$t2 \leq 3{,}600\ \text{seconds.}$$

4. The method according to claim 1, wherein in the tempering, the tempering temperature T2 satisfies 300° C.≤T2≤550° C., the heating start temperature ranges from room temperature to 200° C., and the cooling completion temperature ranges from 200° C. to room temperature.

* * * * *